US007766247B2

(12) United States Patent
Wilnechenko et al.

(10) Patent No.: US 7,766,247 B2
(45) Date of Patent: Aug. 3, 2010

(54) COMBINATION DIESEL/ELECTRIC HEATING APPLIANCE SYSTEMS

(75) Inventors: Bruce Conrad Wilnechenko, Burnaby (CA); Edgar C. Robinson, Vancouver (CA)

(73) Assignee: International Thermal Investments Ltd., Richmond, British Columbia (CA)

( * ) Notice: Subject to any disclaimer, the term of this patent is extended or adjusted under 35 U.S.C. 154(b) by 11 days.

(21) Appl. No.: 10/999,905

(22) Filed: Nov. 29, 2004

(65) Prior Publication Data

US 2005/0139690 A1 Jun. 30, 2005

(51) Int. Cl.
*B60H 1/02* (2006.01)

(52) U.S. Cl. ..... 237/12.3 B; 237/12.3 R; 165/41; 165/42

(58) Field of Classification Search ..... 237/12.3 R, 237/12.3 B; 165/41, 42; 123/142.5 E
See application file for complete search history.

(56) References Cited

U.S. PATENT DOCUMENTS 3,645,327 A * 2/1972 Henley ..... 165/51
5,067,652 A * 11/1991 Enander ..... 237/81
5,255,733 A * 10/1993 King ..... 165/299
5,291,960 A * 3/1994 Brandenburg et al. ..... 180/65.2
5,775,582 A * 7/1998 Hammer ..... 237/8 A
5,901,780 A * 5/1999 Zeigler et al. ..... 165/42
5,906,177 A * 5/1999 Okabe et al. ..... 122/26
6,332,580 B1 * 12/2001 Enander et al. ..... 237/2 A
6,383,672 B1 * 5/2002 Fujita ..... 429/26
6,389,226 B1 * 5/2002 Neale et al. ..... 392/485
6,448,535 B1 * 9/2002 Ap ..... 219/208
6,454,180 B2 * 9/2002 Matsunaga et al. ..... 237/12.3 B
6,834,709 B2 * 12/2004 Shirota et al. ..... 165/43

* cited by examiner

*Primary Examiner*—Carl D Price
(74) *Attorney, Agent, or Firm*—John Russell Uren

(57) ABSTRACT

A diesel/electric appliance for heating coolant within an auxiliary heater circuit and for heating potable water within a potable water circuit. The appliance includes a diesel powered auxiliary heater and a coolant jacket surrounding the burner of the auxiliary heater. Electrical resistance elements are immersed within the coolant jacket to maintain the temperature of the potable water circuit by transferring heat through a heat exchanger to the potable water circuit.

3 Claims, 3 Drawing Sheets

COMBINATION DIESEL/ELECTRIC HEATING APPLIANCE SYSTEMS

INTRODUCTION

This application relates to a combination diesel/electric heating appliance and, more particularly, to a diesel/electric heating appliance particularly useful in vehicles and boats in which heated coolant is provided to a zone heating circuit and in which heated potable water is further generated.

BACKGROUND OF THE INVENTION

Powered hot water heaters used for zone heating and for heating potable water are, of course, known. Such heaters utilize a fuel to allow a combustion engine to generate heat which heat is exchanged within a heat exchanger to a potable water circuit which is used for personal use by the occupants of a vehicle or boat. In addition to the combustion engine, there may also be an auxiliary heater used for supplying heated fluid to the potable water circuit when the engine is shut down and which auxiliary heater may supplement the generation of heat by the engine when the engine is operating if required.

There are disadvantages inherent in existing burners and heaters. One disadvantage is that the auxiliary heater is frequently operated to maintain the potable water in the potable water heating circuit at a desired operating temperature. This operation creates undesirable noise to which the occupants of the boat or vehicle are subjected.

A further disadvantage with existing burners and heaters is that a plurality of heat exchangers may be required for the various fluid circuits, namely the auxiliary heater primary heating loop, the vehicle engine heating loop and the potable water loop. Heat exchangers are expensive and it is desirable to reduce the hardware necessary for heat exchange between the various loops thereby reducing the manufacturing costs.

Yet a further disadvantage of existing heaters lies in the coolant jacket surrounding the burner. The auxiliary heater acts as a pressure vessel and the fluid within the coolant jacket is heated. This creates a rise in pressure due to the closed loop type system used for the coolant circuit. The fluctuations in pressure create a fluctuating force on the wall of the coolant jacket which, over time, causes fluctuating wall deflection which is associated with fatigue failure. It is desirable to minimize the pressure fluctuations in the coolant jacket and apply a more even force throughout the jacket walls which will thereby extend the life of the coolant jacket surrounding the burner.

Yet a further disadvantage of existing heater systems lies in the heating of the potable water used in the system. Heretofore, the auxiliary heater was turned on to heat water when the potable water temperature decreased to a predetermined value which was sensed by a control system which, in turn, initiated operation of the auxiliary heater. This, however, resulted in significant temperature differences at the tap which is uncomfortable for users.

Yet a further disadvantage with existing heater systems is that the heating system must initially be filled with coolant and the embedded air within the system must be purged. These operations necessarily take a good deal of time to ensure the integrity of the coolant filling and pressure testing operations.

SUMMARY OF THE INVENTION

According to one aspect of the invention, there is provided a heat exchanger for a boat or vehicle utilising at least three circuits for circulating fluid, said heat exchanger allowing heat transfer from at least one of said circuits to at least one of said remaining circuits during circulation of said fluid through at least two of said circuits.

According to a further aspect of the invention, there is provided an auxiliary heater for a boat or vehicle having a burner and a fluid jacket surrounding said burner for circulating said fluid through said auxiliary heater, said fluid jacket having a peripheral water retaining surface in contact with said fluid, said water retaining surface being a plurality of convex and concave surfaces smoothly joined together, said concave surfaces being located at the corners of said fluid jacket and said convex surfaces being located between said corners of said fluid jacket.

According to yet a further aspect of the invention, there is provided a potable water circuit for a boat or vehicle, said potable water circuit comprising at least one tap, at least one source of heat with a coolant pump for heating said potable water, a mixer valve for regulating the temperature of said water at said tap, a source of potable water for said potable water circuit and a flow sensor within said potable water circuit to initiate operation of said coolant pump when water is emitted from said tap.

According to still yet a further aspect of the invention, there is provided an auxiliary heater circuit used to provide heat to a boat or vessel, said auxiliary heater circuit comprising quick connect connections for attachment to a fill and purge assembly, said quick connect connections having check valves to prevent the flow of fluid and/or air from said connections when said connections between said auxiliary heater circuit and said fill and purge assembly are no longer connected.

According to still yet a further aspect of the invention, there is provided electrical resistance elements for supplemental electrical heating of auxiliary heater coolant, said electrical resistance elements comprising at least one 120 VAC element and at least one 240 VAC element, each of said elements being connected to a controller, said controller initiating operation of either said 120 VAC element or said 240 VAC element according to electrical power available for said electrical resistance elements.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

Figure 1:
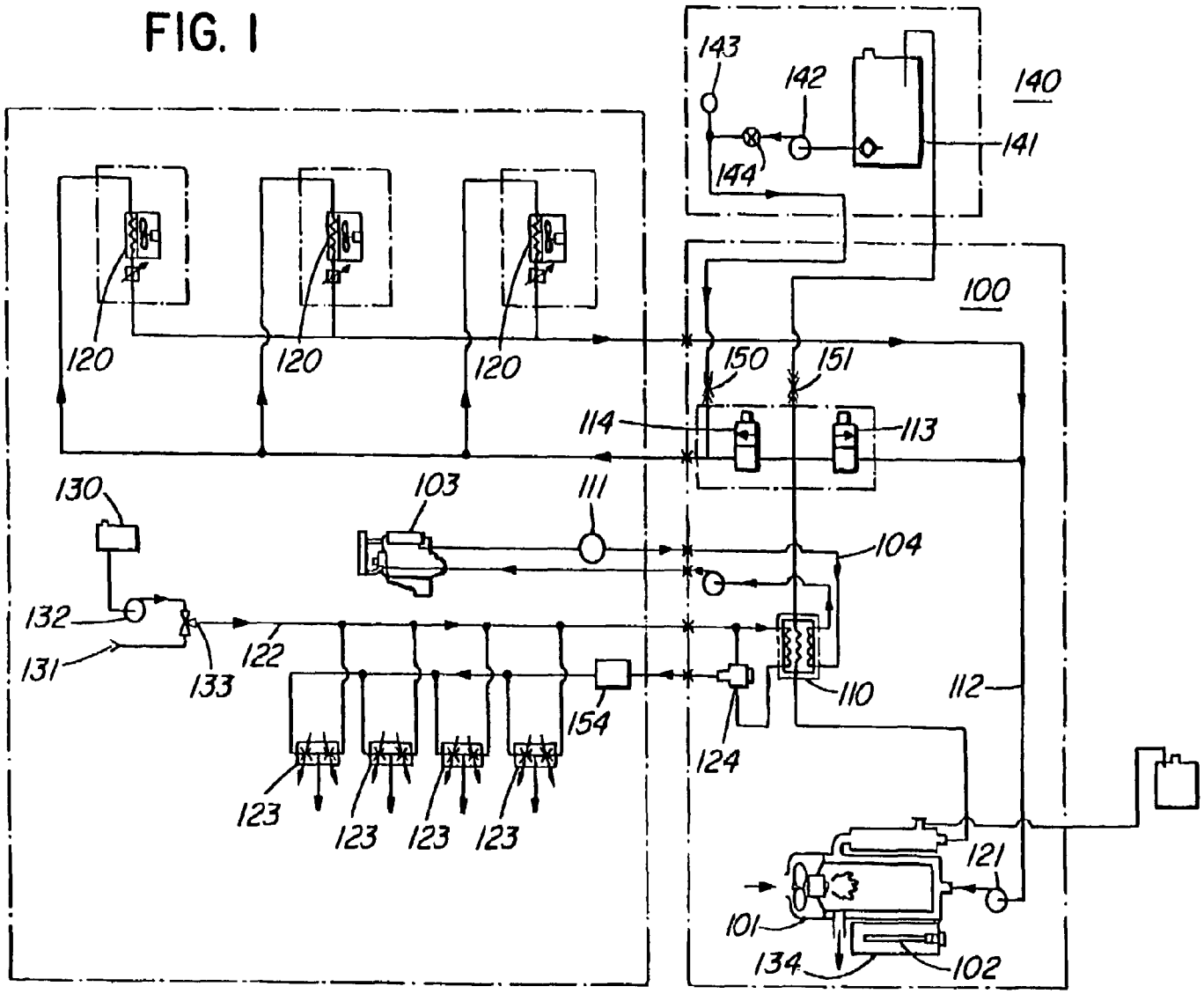
FIG. 1 is a diagrammatic schematic of the combination diesel/electric appliance system according to the invention, and which further shows the fill and purge pump assembly connected to the auxiliary heater circuit.

Referring now to the drawings, a combination diesel/electric appliance system is shown generally at 100 in FIG. 1. It comprises three principal heating components for increasing the temperature of fluid in the heating circuits, namely diesel powered auxiliary heater 101, electric resistance heaters 102 and diesel engine 103.

Each of the heaters 101, 102, 103 has an associated fluid circuit. Engine 103 has an associated engine heating loop 104 which circulates engine fluid through the engine 103 and through heat exchanger 110 utilising pump 111. Auxiliary heater 101 has an auxiliary heating loop 112 associated therewith which loop 112 extends from the auxiliary heater 101 and passes through heat exchanger 110 and then through either summer valve 113 or winter valve 114 as will be described. Zone heaters 120 are provided and are associated with the winter valve 114, when it is open, to allow the circulation of heated coolant through the zone heaters 120, three (3) zone heaters 120 being conveniently shown. Pump 121, associated with auxiliary heater 101, circulates coolant through the auxiliary heater loop 112.

A potable water circuit or loop 122 extends through heat exchanger 110 and is conveniently associated with four (4) taps 123. A mixer valve 124 adjusts the quantity of hot and cold water proceeding to the taps 123. Two (2) sources of cold water are illustrated, namely a first source being a potable water tank 130 and a second source being a city water connection 131; that is, if the vehicle or boat in which the appliance system 100 is installed is being operated away from a moorage or away from a city or municipal source of water, the potable water tank 130 will be utilised in association with pump 132. A valve 133 is utilised to select one of either the water tank 130 or the city water source 131.

The electric resistance heater 102 conveniently comprises two (2) 1800 watts AC heating elements to provide supplemental potable water heating. The elements are immersed in the coolant jacket 134 surrounding the burner 107 which conveniently provides approximately 5 U.S. gallons of coolant to the auxiliary heating circuit 112. The elements 102 allow the temperature of the coolant in the coolant jacket 134 to be maintained when minimal quantities of hot water are required thereby avoiding the necessity of cycling the auxiliary heater 101 and causing unwanted noise to the users of the boat or vehicle.

One of the heating elements is a 120 VAC@30 amp element. The other element is a 240 VAC@50 amp element or, alternatively, two (2) elements of the 120 VAC@30 amp type variety. An embedded microprocessor is associated with the heating elements 102. The microprocessor senses the electrical power available for the elements 102 and initiates operation of the proper one of the elements 102 based on the power available.

An associated fill and purge pump assembly is generally illustrated at 140. It is associated with the auxiliary heater circuit 112 but is a stand alone fixture. The fill and purge assembly 140 has a coolant drum 141 holding coolant to be used to fill the auxiliary heater circuit 112 when the system is initially filled as may be the case when the system is installed by an OEM manufacturer. A pump 142, a flow meter 144 and a pressure gauge 143 are associated with the fill and purge assembly 140 to properly maintain the coolant flow from the fill and purge assembly 140 to the auxiliary heater circuit 112. When a coolant circuit is connected with the fill and purge assembly 140, coolant is automatically provided to the circuit and air embedded within the circuit will be automatically purged during the filling operation. The pressure of the coolant within the circuit 112 and the flow of coolant into the circuit 112 can be conveniently observed on the pressure gauge 143 and the flow meter 140 during the filling and purging operation.

Quick connect assemblies 150, 151, having check valves, are conveniently provided to allow the auxiliary heating loop 112 to be initially filled with coolant from the coolant tank 141. When the loop 112 is full of coolant as observed by the pressure gauge 143 and the air has been bled from the circuit 112, the operator can conveniently remove the quick disconnect connector assemblies 150, 151 thereby isolating the circuit 112.

Figure 2:
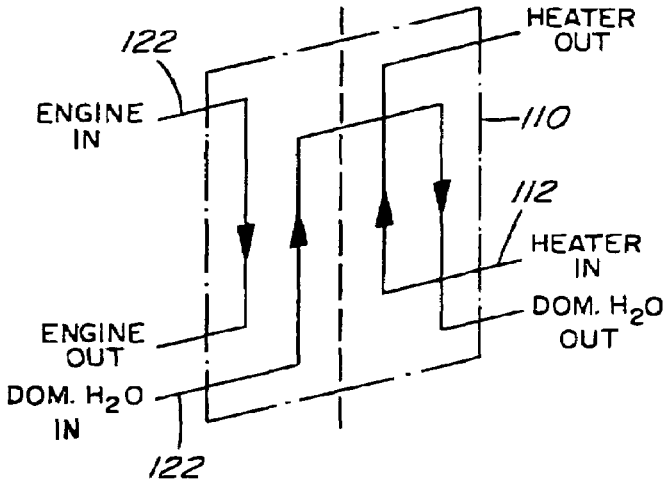
FIG. 2 is a diagrammatic illustration of the fluid flow through the heat exchanger according to the invention.
Figure 3A:
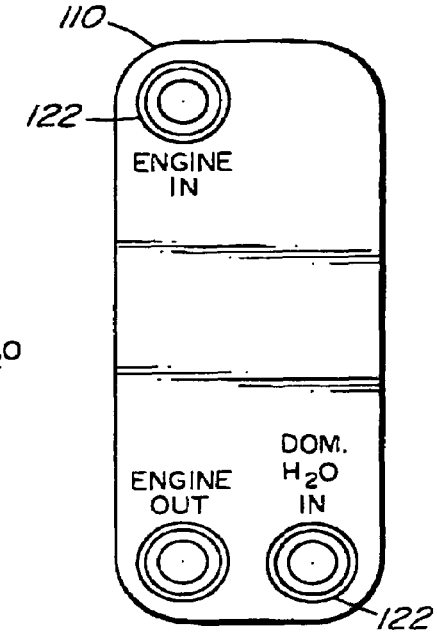
FIGS. 3A, 3B and 3C are diagrammatic views of the heat exchanger in front, side and rear views, respectively.
Figure 3B:
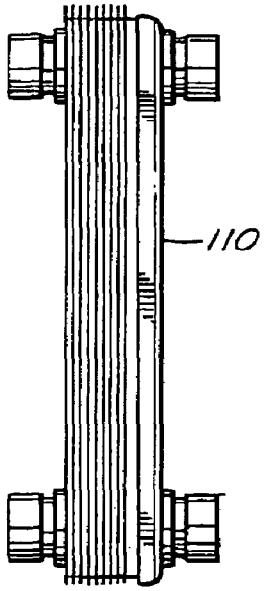
Figure 3C:
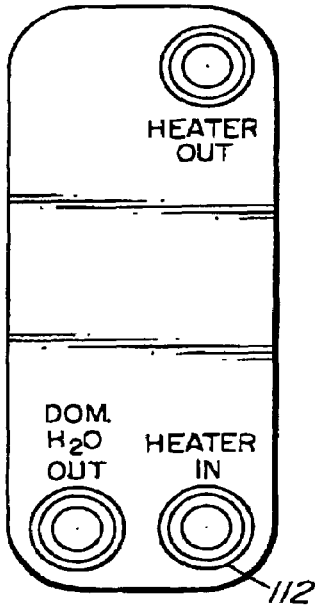

Referring now to FIG. 2, the flow of the various circuits through the heat exchanger 110 is illustrated, namely the flow of coolant through the engine circuit 122, the flow of coolant through the auxiliary heater circuit 112 and the flow of potable water through the potable water circuit 122. The heat exchanger 110 is illustrated further in FIGS. 3A, 3B and 3C with the engine circuit input 122 and the potable water circuit input 122 being illustrated in FIG. 3A and the auxiliary coolant circuit 112 being illustrated in FIG. 3C.

Figure 4:
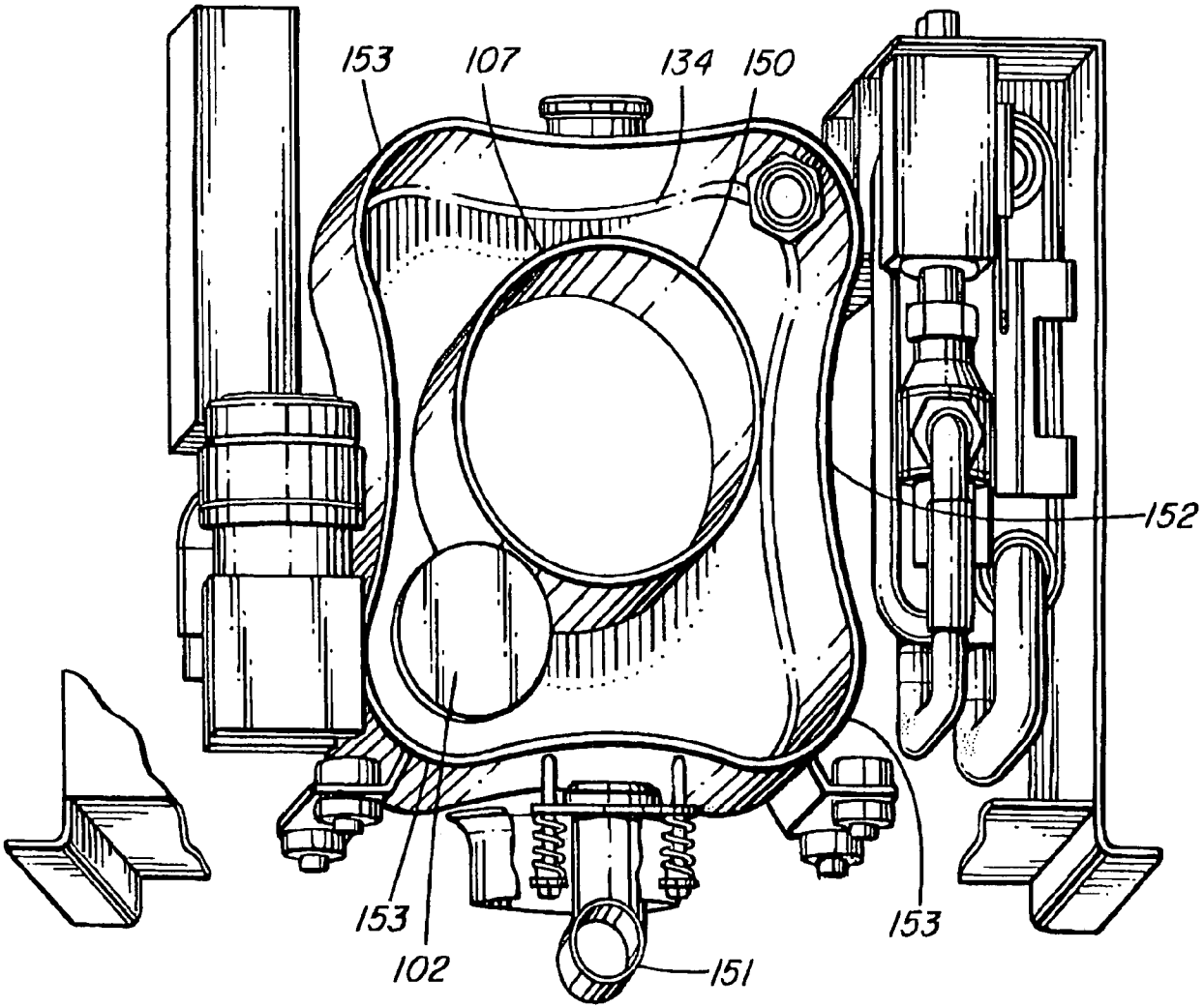
FIG. 4 is a diagrammatic and isometric cutaway and partial view of the auxiliary heater according to the invention particularly illustrating the periphery of the coolant jacket surrounding the burner.

Reference is now made to FIG. 4 wherein a partial view of the auxiliary heater 101 is illustrated. The auxiliary heater 101 includes the coolant jacket 134 which surrounds the central core 150 in which the burner is operated and which contains the combustion flame from the burner 107 used to heat the coolant in the coolant jacket 134. The coolant jacket 134 also includes the electrical elements 102. It will be noted there are no ninety (90) degree bends of metal in the periphery of the coolant jacket 134. Rather, there are a series of curved surfaces 152 which are generally concave surfaces with respect to the central core 150 in the central areas of the heater 101 and which are generally convex with respect of the central core 150 in the corner areas 153 of the coolant jacket 134. The concave and convex surfaces are joined smoothly together to eliminate or reduce stress buildup at specific locations. As the coolant in the coolant jacket 134 is under some pressure, conveniently seven (7) psi in the present instance, the use of the curved surfaces is designed to allow the force from the pressure to be smoothly dissipated throughout the coolant jacket 134 and to also minimize the deflection of the coolant jacket 134 during the operation of the auxiliary heater circuit 101. Higher or lower pressures could also be used with the curved surfaces of the coolant jacket 134 being appropriately designed.

A flow sensor 154 is associated with the potable water loop 122. The flow sensor 154 is located on the outlet side of the heat exchanger 110 and the outlet side of the mixer valve 124. The flow sensor 154 senses any use of water being released from the taps 123 and, by way of a controller or embedded microprocessor, immediately commences operation of the pump 121 in the auxiliary heater circuit 112 thereby allowing for heat within the auxiliary heater loop 112 to be transferred to the potable water circuit 122 within heat exchanger 110.

OPERATION

In operation, it will initially be assumed that the auxiliary heater 101 has been installed in the boat or vehicle and that coolant must be added to the auxiliary heater circuit 112.

The operator will connect the complementary quick connect fittings 150, 151 on both the circuit from the fill and purge assembly 140 and the auxiliary circuit 112. Pump 142 will be initiated to commence coolant flow into the auxiliary circuit from the coolant tank 141 through the flow meter 144 while the pressure within the circuit 112 is observed on pressure gauge 143. Entrained air within the auxiliary heater circuit 112 will be purged by use of the fill and purge assembly 140 while the pressure within the auxiliary heater circuit 112 is monitored until the correct pressure is reached. The quick connect fittings 150, 151 are then easily removed thereby isolating the auxiliary circuit 112 from the fill and purge pump assembly 140 which is now properly filled with coolant and which is now maintained at the correct pressure.

It will next be assumed that the vessel or vehicle is being utilised either away from a dock, in the case of a boat, or on the road, in the case of a vehicle. It will further be assumed that the "winter" coolant flow circuit is required; that is, that the zone heaters 120 will be utilised to heat the various heating zones in the boat or vessel.

Domestic or potable water may be provided to the taps 123 simultaneously with the coolant provided to the heat exchangers 110 with the amount of heat being delivered being limited by the thermal capacity of the auxiliary heater 101 which includes the resistive elements 102.

In this event, potable water from the potable water tank 130, being circulated by pump 132, will be used with valve 133 being closed to the city water source 131. Likewise, winter valve 114 will be open to allow coolant in the auxiliary heater circuit 112 to circulate through the zone heaters 120 and thereby heat the various zones in which the zone heaters 120 are located. Such circulation through the winter valve 114 is controlled by thermostats (not illustrated) within the heating zones of the vessel or vehicle. If winter valve 114 is open, summer valve 113 will be closed. In a first case, engine 103 will be operating with the boat or vessel underway and the heat generated by the engine 103 will be circulated through pump 11 within engine heating loop 104. In this event, the auxiliary heater 101 may not be required for heating purposes and will not normally be under operation. The heated coolant from the engine 103 circulates through heat exchanger 110 where heat from the heated engine coolant is transferred to both the potable water circuit 122 and to the auxiliary heating loop 112, the water in the potable water loop 122 being circulated through the heat exchanger 110 under the influence of pump 132 and the coolant in the auxiliary water circuit 112 being circulated through the heat exchanger under the influence of pump 121. Pump 132 is a pressure controlled pump such that when the taps 123 are opened, the pressure within the potable water circuit 122 drops thereby initiating operation of pump 132 to maintain the circuit pressure. Pump 121 is initiated both by the thermostats in the zone heating areas and by the flow control switch 154 which indicates when potable water is required at the taps 123.

In the event the temperature of the coolant within the auxiliary heater circuit 112 drops below a predetermined value, conveniently about 140 deg. F., which temperature is selectable by appropriate software with the system 100 and by an appropriate temperature sensor in auxiliary heater circuit 112, or in the event the potable water within the potable water circuit 112 is being used, the auxiliary heater 101 will commence its operation to provide auxiliary heat to the coolant in the auxiliary circuit 112 and to circulate such heated coolant under the influence of pump 121 through the heat exchanger 110 thereby to provide additional heat to the coolant circulating through the zone heaters 120 and to provide additional heat to the potable water circuit 122 until the maximum set point is reached whereupon the auxiliary heater 101 will shut down. As heat is used by the zone heaters 120 or the taps 123, and when diesel or AC heat is selected by the user on a control panel within the vessel or vehicle, the temperature in the auxiliary heater circuit 112 will drop until a lower set point is reached whereupon the operation of the auxiliary heater 101 again commences.

It will next be assumed that the boat or vehicle is no longer in a transportation mode and that a standing location has been reached with a water hookup being available. In this event, the potable water circuit 122 is connected to the water source 131 and the valve 133 is closed to the potable water tank 130, it being understood that, if necessary, three way valve 133 may also be switched to a position where water from the water source 131 can be passed to the coach potable water tank 130 to replenish the water supply held in the tank 130. The engine 103 will not be operating and the auxiliary heater 101 will be the sole source of heat for the heat exchanger 110. Additional engine heat may be provided by manually initiating engine operation.

In the event the demand for potable water is minimal such as might be the case at night or when the users of the boat or vehicle are not active, the electric resistance heater 102 maintains the "topping off" temperature of the coolant within the coolant jacket 134. The electrical resistance heaters 102 are, of course, relatively noiseless compared to the operation of the auxiliary heater 101 and, therefore, there will be no undue switching on and off of the auxiliary heater 101 which causes objectionable noise to the users. Likewise, a minimal use of water from the taps 123 is intended to similarly not initiate operation of the auxiliary heater 101. The flow of water within the potable water circuit 122 is sensed by flow sensor 154 and a minimal flow will not initiate operation of the auxiliary heater 101. However, when a minimal flow in potable water circuit 122 is reached, the operation of the auxiliary heater 101 will be initiated to supplement the heat in the potable water circuit 122 provided by the electrical heating elements 102. This would happen, for example, if a user was taking a shower.

In the event no heat is added to the zone heaters 120, the summer valve 113 in the auxiliary heating circuit 112 is opened and the winter valve 114 is closed. The coolant within the auxiliary heating circuit 112 will therefore circulate only through the heat exchanger 110 and then return to the auxiliary heater 101 through summer valve 113.

Many modifications will readily occur to those skilled in the art to which the invention relates and the specific embodiments herein described should be taken as illustrative of the invention only and not as limiting its scope as defined in accordance with the accompanying claims.

We claim:

1. A heat exchanger for a boat or vehicle utilizing an engine circuit, a potable water circuit and a auxiliary heater circuit, each of said circuits carrying a separate fluid and being isolated from said remaining circuits so as to prevent mixing with any of said remaining circuits, either or both of said engine circuit and said auxiliary heater circuit providing heat to said potable water circuit, and a fluid flow volume sensor in said potable water circuit, said fluid flow volume sensor being operably connected to a controller, said controller initiating operation of said auxiliary heater circuit following a predetermined volume flow of said potable water being reached and measured by said fluid flow volume sensor.

2. A heat exchanger as in claim 1 wherein said auxiliary hater further comprises an electrical resistance element immersed in coolant fluid associated with said auxiliary heater circuit.

3. A heat exchanger as in claim 2 wherein said auxiliary heater has a burner and said electrical resistance element is immersed within a coolant jacket surrounding said burner.

* * * * *